US006657375B2

(12) United States Patent
Goud

(10) Patent No.: US 6,657,375 B2
(45) Date of Patent: Dec. 2, 2003

(54) FLUORESCENT LAMP AND METHOD FOR MANUFACTURING THE SAME

(75) Inventor: Leendert Huibert Goud, Roosendaal (NL)

(73) Assignee: Koninklijke Philips Electonics N.V., Eindhoven (NL)

( * ) Notice: Subject to any disclaimer, the term of this patent is extended or adjusted under 35 U.S.C. 154(b) by 0 days.

(21) Appl. No.: 10/046,627

(22) Filed: Jan. 14, 2002

(65) Prior Publication Data

US 2002/0096991 A1 Jul. 25, 2002

(30) Foreign Application Priority Data

Jan. 15, 2001 (EP) ..... 01200127

(51) Int. Cl.[7] ..... H01J 1/62; H01J 17/02; H01J 17/20; H01J 17/16

(52) U.S. Cl. ..... 313/493; 609/573; 609/634

(58) Field of Search ..... 313/493, 609–611, 313/573, 634, 483, 484; 445/26

(56) References Cited

U.S. PATENT DOCUMENTS 4,481,442 A * 11/1984 Albrecht et al. ..... 313/493
5,055,738 A * 10/1991 Yorifuji et al. ..... 313/490
5,896,003 A * 4/1999 Gehring ..... 445/26
6,148,638 A * 11/2000 Oga et al. ..... 65/59.2

FOREIGN PATENT DOCUMENTS

GB 2335538 9/1999 ..... H01J/9/24

* cited by examiner

*Primary Examiner*—Sandra O'Shea
*Assistant Examiner*—Peter Macchiarolo
(74) *Attorney, Agent, or Firm*—Ernestine C. Bartlett

(57) ABSTRACT

The invention describes a fluorescent lamp comprising four or a larger, even number of glass tubes (3,6) connected by respective bridge parts (5,9,10) to form a discharge path through the tubes, said lamp is constructed from two or more dual shaped lamp parts (1,2) each comprising two substantially straight tubes (3) parallel to each other, each tube comprising a sealed end (4), and a first bridge part (5) near the sealed ends to join the tubes, wherein the bridge part (5) of one dual shaped lamp part (1) is located at a distance d1 from the sealed ends (4) of the tubes (3), whereas the bridge part (9) of the other dual shaped lamp part(s) (2) is located at a distance d2 from the sealed ends (7) of the tubes (6), said distance d2 is shorter than the distance d1 such that only a cold spot (8) is formed in a tube end part of one of the dual shaped lamp parts (1).

3 Claims, 3 Drawing Sheets

FLUORESCENT LAMP AND METHOD FOR MANUFACTURING THE SAME

TECHNICAL BACKGROUND/FIELD OF THE INVENTION

The present invention relates to a fluorescent lamp including two electrodes and 2n glass tubes, where n is at least 2. the tubes being connected by respective bridge parts to form a discharge path through the tubes between the two electrodes. The invention further relates to a method for manufacturing such a fluorescent lamp.

A method for manufacturing a fluorescent lamp with eight tubes is described in UK Patent Application GB 2 335 538. The lamp is assembled from four dual tubes that are previously manufactured. Dual tubes are manufactured from two parallel glass tubes each having one end sealed. The tubes are connected to each other by means of a bridge near the sealed tube ends. The distance created between the bridge and the sealed tube ends is of such a dimension that a cold spot is created in both tube end parts. These cold spots are intended for mercury vapor pressure control and, as mercury vapor pressure determines the lamp lumen output, the effectiveness of the lamp. In the finished lamp the number of cold spots equals the number of tubes, e.g. in the lamp according to GB 2 335 538 there are eight cold spots. The creation of more cold spots than one being needed for mercury vapor pressure control is at the expense of light-emitting tube area, resulting in a lower luminous flux or longer lamp length.

SUMMARY OF THE INVENTION

The object of the invention is to provide an improved fluorescent lamp for which above-mentioned drawback does not arise.

This object is achieved in accordance with the invention with a fluorescent lamp defined in the introduction which is characterized in that the first bridge part of the first dual shaped lamp part is located at a distance d1 from the sealed ends of the tubes, and that the second bridge part of the second dual shaped lamp part is located at a distance d2 from the sealed ends of the tubes, wherein the distance d2 is shorter than the distance d1 such that only a cold spot is formed in a tube end part of the first dual shaped lamp part. Only one dual shaped lamp part has a cold spot, while the or each other dual shaped lamp part fully utilizes its length for the gas discharge, light-emitting area, which will result in a higher lumen output or reduced total lamp length.

The invention also relates to a method for manufacturing a fluorescent lamp as defined in claim 2.

BRIEF DESCRIPTION OF THE DRAWINGS

The invention also relates to a method for manufacturing a fluorescent lamp, the lamp comprising two electrodes and 2n glass tubes, where n is at least 2, the tubes being connected by respective bridge parts to form a discharge path through the tubes between the two electrodes, the method comprising the steps of.

a) manufacturing a first dual shaped lamp part by disposing two substantially straight tubes parallel to each other, each tube being sealed at one end, and joining the tubes near the sealed ends with a first bridge part, b) manufacturing at least a second dual shaped lamp part by disposing two substantially straight tubes parallel to each other, each tube being sealed at one end, and joining the tubes near the sealed ends with a second bridge part, and c) mutually connecting the first and second dual shaped lamp parts with bridge parts near the ends of the tubes opposite to the sealed ends thereof, characterized in that during step a) the first bridge part is formed at a distance d1 from the sealed ends of the tubes, and that during step b) the second bridge part is formed at a distance d2 from the sealed ends of the tubes, said distance d2 being shorter than said distance d1, whereby cold spots are only formed near the sealed ends of the tubes of the first dual shaped lamp part.

DESCRIPTION OF THE PREFERRED EMBODIMENTS

Figure 1:
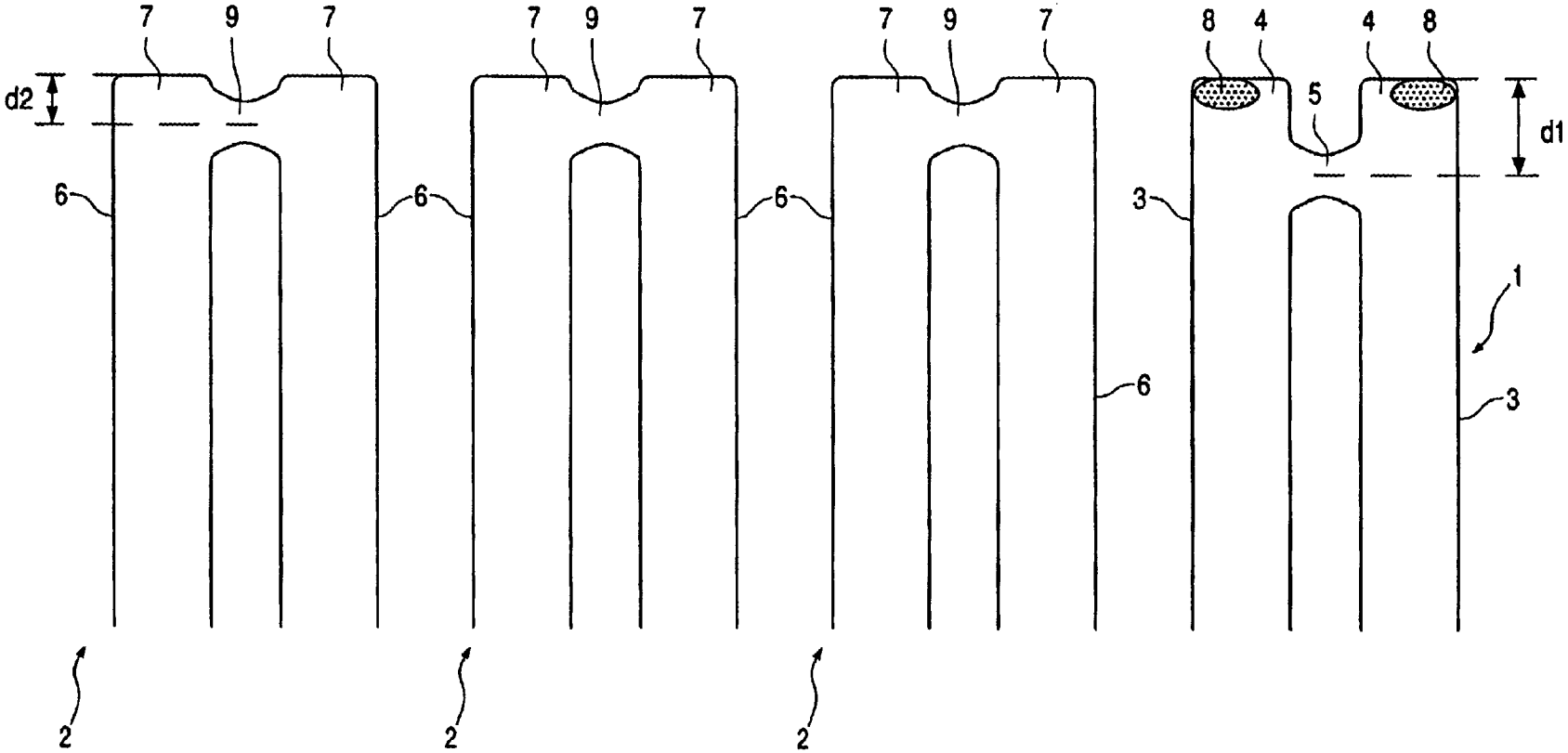
FIG. 1 illustrates schematically four dual shaped lamp parts for an eight tube lamp according to one embodiment of the invention.

FIG. 1 shows schematically one first dual shaped lamp part 1 and three second dual shaped lamp parts 2 for an eight tube lamp. The first dual shaped lamp part 1 has two substantially straight tubes 3, which are parallel to each other. Each tube has one sealed end 4. Near the sealed ends 4, the tubes 3 are joined by means of a first bridge part 5. The first bridge part 5 is located at a distance d1 from the sealed ends 4 of the tubes 3. The second dual shaped lamp parts 2 each have two tubes 6, which are parallel to each other and have sealed ends 7 at one side. The tubes 6 are connected mutually by second bridge parts 9, located at distance d2 from the sealed ends 7. The distance d2 is shorter than the distance d1 such that only a cold spot 8 is formed in a tube end part of the first dual shaped lamp part 1.

Figure 2:
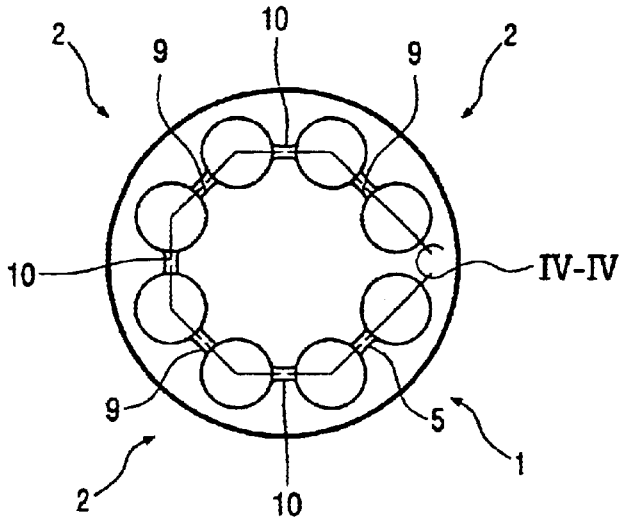
FIGS. 2 and 3 respectively are a top and front view of the eight tube lamp.
Figure 3:
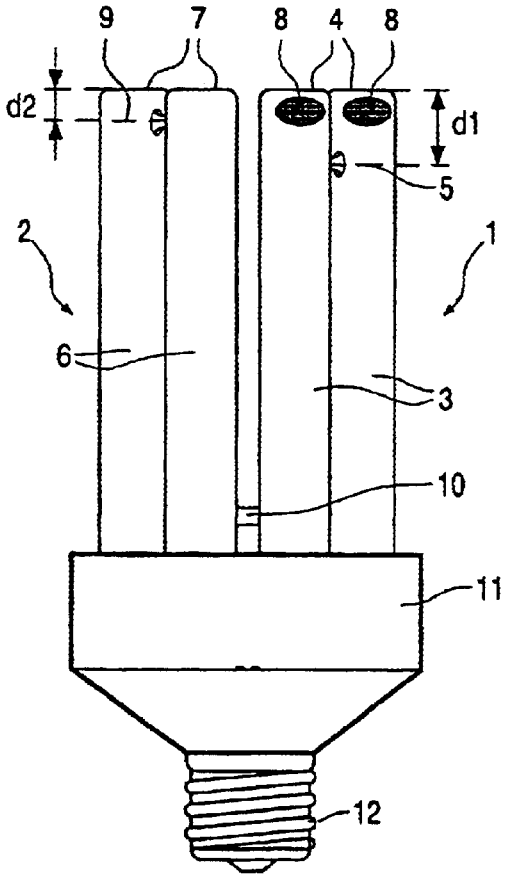

In FIGS. 2 and 3 respectively a top and front view of a eight tube lamp manufactured from the dual shaped lamp parts 1,2. In manufacturing the lamp from dual shaped lamp parts 1,2, these are mutually connected by bridge parts 10 at the end of the tubes 3, 6 opposite to the sealed ends 4,7 thereof. The assembly of tubes 3,6 are finally placed in a lamp base 11 provided with screw thread 12.

Figure 4:
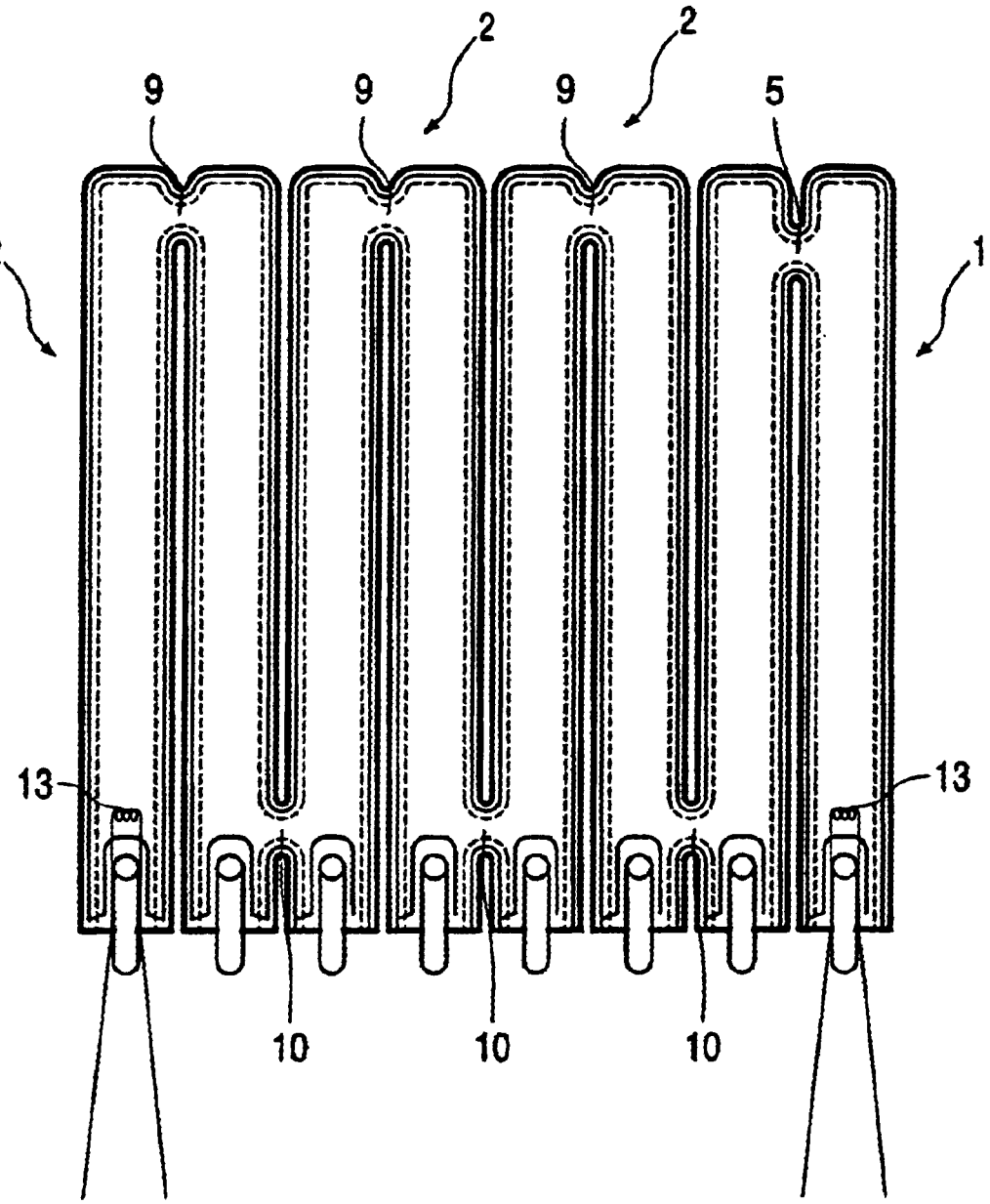
FIG. 4 is a sectional view according to line IV—IV in FIG. 2.

Finally, FIG. 4 shows a sectional view according to line IV—IV in FIG. 2. The cold spots 8 are located in the first dual shaped lamp part 1 at the right of FIG. 4. Because the tubes 3,6 are mutually connected by bridge parts 5,9,10 a discharge path is formed through the tubes 5,9,10 between two electrodes 13, which are provided in one tube each. As only the first dual shaped lamp part 1 has cold spots 8, the tubes 6 of the three other dual shaped lamp parts 2 use their full length for the gas discharge, light-emitting area, which results in a higher lumen output compared to an eight tube lamp known from the prior art which has eight cold spots, one in each tube.

What is claimed is:

1. Fluorescent lamp including two electrodes and 2n glass tubes, where n is at least 2, the tubes being connected by respective bridge parts to form a discharge path through the tubes between the two electrodes, the lamp comprising:

a first dual shaped lamp part which comprises two substantially straight tubes, each tube having a sealed end, the tubes aligned parallel to each other with the sealed ends adjacent each other, and a first bridge part near the sealed ends to join the tubes, at least a second dual shaped lamp part which comprises two substantially straight tubes, each tube having a sealed end, the tubes aligned parallel to each other with the sealed ends adjacent each other, and a second bridge part near the sealed ends to join the tubes, and at least a third bridge part for mutually connecting the first and second dual shaped lamp parts near the ends of the tubes opposite to the sealed ends thereof, characterized in that the first bridge part of the first dual shaped lamp part is located at a distance d1 from the sealed ends of the tubes, and that the second bridge part of the second dual shaped lamp part is located at a distance d2 from the sealed ends of the tubes, wherein the distance d2 is shorter than the distance d1, whereby cold spots are only formed near the sealed ends of the tubes of the first dual shaped lamp part.

2. Method for manufacturing a fluorescent lamp, the lamp comprising two electrodes and 2n glass tubes, where n is at least 2, the tubes being connected by respective bridge parts to form a discharge path through the tubes between the two electrodes, the method comprising the steps of:

a) manufacturing a first dual shaped lamp part by disposing two substantially straight tubes parallel to each other, each tube being sealed at one end, and joining the tubes near the sealed ends with a first bridge part, b) manufacturing at least a second dual shaped lamp part by disposing two substantially straight tubes parallel to each other, each tube being sealed at one end, and joining the tubes near the sealed ends with a second bridge part, and c) mutually connecting the first and second dual shaped lamp parts with bridge parts near the ends of the tubes opposite to the sealed ends thereof, characterized in that during step a) the first bridge part is formed at a distance d1 from the sealed ends of the tubes, and that during step b) the second bridge part is formed at a distance d2 from the sealed ends of the tubes, said distance d2 being shorter than said distance d1, whereby cold spots are only near the sealed ends of the tubes of the first dual shaped lamp part.

3. Fluorescent lamp comprising an array of substantially parallel 2n glass tubes, where n is at least 2, the glass tubes being of approximately the same length and connected by bridge parts to form a serpentine discharge space between first and second electrodes located at opposite ends of the discharge space, the array of substantially parallel 2n glass tubes comprising:

a first dual shaped lamp part comprising first and second substantially straight tubes, the first electrode located at an electrode end of the first tube, both tubes having a sealed end remote from the electrode end, and a first bridge part connecting the tubes near the sealed ends remote from the electrode end;

at least a second dual shaped lamp part comprising first and second substantially straight tubes, the second electrode located at an electrode end of the first tube, both tubes having a sealed end remote from the electrode end, and a second bridge part connecting the tubes near the sealed ends remote from the electrode end;

at least a third bridge part connecting the second glass tube of the first dual shaped lamp part with the second glass tube of the second dual shaped lamp part;

characterized in that the first bridge part of the first dual shaped lamp part is located at a distance d1 from the sealed ends of the tubes, and that the second bridge part of the second dual shaped lamp part is located at a distance d2 from the sealed ends of the tubes, wherein the distance d2 is shorter than the distance d1, whereby cold spots are only formed near the sealed ends of the tubes of the first dual shaped lamp part.

* * * * *